US010094064B2

(12) United States Patent
Champagne et al.

(10) Patent No.: US 10,094,064 B2
(45) Date of Patent: Oct. 9, 2018

(54) PORTABLE DRYING RACK

(71) Applicant: CHAMPAGNE INDUSTRIES INC., Saint-Georges (CA)

(72) Inventors: Éric Champagne, St-Georges (CA); Norman Bédard, St-Joseph-de-Coleraine (CA)

(73) Assignee: CHAMPAGNE INDUSTRIES INC., Saint-Georges (CA)

( * ) Notice: Subject to any disclaimer, the term of this patent is extended or adjusted under 35 U.S.C. 154(b) by 0 days.

(21) Appl. No.: 15/490,538

(22) Filed: Apr. 18, 2017

(65) Prior Publication Data

US 2017/0298564 A1 Oct. 19, 2017

Related U.S. Application Data

(60) Provisional application No. 62/323,922, filed on Apr. 18, 2016.

(51) Int. Cl.
*D06F 57/04* (2006.01)
*A47B 43/00* (2006.01)

(52) U.S. Cl.
CPC ..... *D06F 57/04* (2013.01); *A47B 43/00* (2013.01)

(58) Field of Classification Search
CPC ..... D06F 57/04; D06F 57/06; D06F 57/08; D06F 57/10; D06F 57/12; D06F 57/122; D06F 57/125; D06F 57/127; D06F 58/18; A47B 43/00; A47G 25/14
See application file for complete search history.

(56) References Cited

U.S. PATENT DOCUMENTS 334,656 A * 1/1886 Goodyear ..... D06F 57/04 211/171
724,582 A * 4/1903 Jones ..... A47F 5/06 211/172
1,185,642 A * 6/1916 Emerson ..... E04H 15/46 108/41
1,236,212 A * 8/1917 Saladee ..... D06F 57/12 211/1.3
2,255,973 A * 9/1941 Hoobler ..... A47C 7/62 211/119.007
2,469,494 A * 5/1949 Bushko ..... A47G 25/0664 211/172

(Continued)

OTHER PUBLICATIONS

Wet Gear Solutions, "The RAACK", http://www.wetgearsolutions.com/the-raack.html.

(Continued)

*Primary Examiner* — Ko H Chan
(74) *Attorney, Agent, or Firm* — Dilworth IP, LLC

(57) ABSTRACT

There is provided a collapsible drying rack for easy packing and transport. The drying rack in configurable between a non-operative compacted configuration to an operative deployed configuration where a plurality of arms extends outwardly of the body for drying operation. Reversible conversion of the rack from the non-operative configuration to the operative configuration is performed by actuation of a triggering assembly. Once deployed, each arm may be used for hanging wet items such as clothes or sport's equipment. The drying rack may be anchored to various types of support via a retainer assembly including one or more elements for clipping and/or hanging the drying rack to the support.

20 Claims, 14 Drawing Sheets

(56) References Cited

U.S. PATENT DOCUMENTS

| | | | | |
|---|---|---|---|---|
| 2,840,241 | A * | 6/1958 | Callais | A47G 25/0671<br>211/119.007 |
| 3,806,399 | A * | 4/1974 | Cocjin | A47G 33/06<br>211/196 |
| 4,144,364 | A * | 3/1979 | Tice | A47G 33/06<br>428/18 |
| 6,702,129 | B1 * | 3/2004 | Harris | A47G 25/0664<br>211/172 |
| 7,122,230 | B1 * | 10/2006 | Maskell | A41G 1/007<br>428/18 |
| 8,573,417 | B1 * | 11/2013 | Anderson | D06F 53/045<br>211/119.01 |
| 2015/0342383 | A1 * | 12/2015 | Gilbert | A47G 25/14<br>248/214 |

OTHER PUBLICATIONS

Sport Chek, "SKLZ Hockey Air Station", FGL Sports Ltd., Copyright 2017, https://www.sportchek.ca/product/331604078.html.

BestHockey.ca, "Wet Gear Single Metal Hockey Dryer Rack", Copyright TronSports.ca 2015, https://besthockey.ca/collections/hockey-racks/products/wet-gear-single-metal-hockey-dryer-rack-1?variant=21886089409.

* cited by examiner

PORTABLE DRYING RACK

FIELD

The present relates to the field of drying racks and more particularly, to a drying rack which is compactable for transportation and which can be deployed and installed on a support for operation.

BACKGROUND

Dealing with wet sport's equipment, particularly when an athlete is travelling (i.e. in a hotel room) may be challenging and improvements are needed in the field.

SUMMARY

Implementations of the present drying rack enable conversion between a compacted non-operative configuration for packing and travelling, and a deployed, operative configuration, for hanging items to dry. The conversion between the two configurations is quick, easy and reliable to provide either a sturdy rack when deployed to hang items and a reduced-sized rack when compacted for storage and transportation.

According to a first aspect, there is provided a drying rack comprising: an elongated body; a plurality of elongated drying arms pivotably mounted to the body and being configurable between an arm-compacted configuration, wherein the drying arms are juxtaposed to the body, and an arm-operative configuration wherein the drying arms branch out from the body; and a handle mounted to the body and being configurable between a handle-operative configuration and a handle-storage configuration, wherein the drying arms are simultaneously configured in the arm-operative configuration by configuring the handle in handle-operative configuration, and in the arm-compacted configuration by configuring the handle in handle-storage configuration.

According to a further aspect, there is provided a drying rack comprising: an elongated body comprising a plurality of elongated cavities; and a plurality of elongated drying arms pivotably mounted to the body and being configurable between an arm-compacted configuration, wherein the drying arms are at least partially inserted in a respective one of the elongated cavities, and an arm-operative configuration wherein the drying arms branch outwardly from the body and the respective one of the elongated cavities; and an arm retaining assembly operatively engageable with the drying arms and configurable in an arm-retaining configuration to maintain the drying arms at least partially inserted the respective one of the elongated cavities and an arm-released configuration to release the drying arms from the respective one of the elongated cavities to be configured into the arm-operative configuration.

In accordance with a further aspect, there is provided a drying rack adapted to be mounted to a drying rack support spaced-apart from a floor, the drying rack comprising: an elongated body; a plurality of elongated drying arms pivotably mounted to the body and configurable between an arm-compacted configuration, wherein the drying arms are juxtaposed to the body and an arm-operative configuration wherein the drying arms branch outwardly from the body; and a drying rack retainer assembly mounted to the body and engageable with the drying-rack support to support in a stable configuration above the floor.

In a first aspect, there is provided a drying rack reversibly configurable between a non-operative configuration and an operative configuration for drying operation. The drying rack includes:

- a main elongated body;
- a plurality of elongated drying arms configured to receive items to be hung, each one of the elongated drying arms having a proximal end pivotably mounted to the main body; and
- a triggering assembly cooperating with the main body and each one of the elongated drying arms to selectively
  - pivot the elongated drying arms towards the main body until the elongated drying arms rest along the main body in the non-operative configuration of the drying rack for storage or transportation, or
  - pivot the elongated drying arms away from the main body until the elongated drying arms extends laterally away from the main body in the operative configuration of the drying rack to allow hanging of the items to dry.

In some implementations, the triggering assembly includes a handle translatable along the main body to trigger the pivoting of the elongated drying arms. The handle includes a shaft slidably engaged with the main body and a gripping member connected at a distal end of the shaft, wherein pulling of the gripping member away from the main body allowing expansion of a portion of the shaft out of the main body.

In some implementations, the main body includes an elongated handle channel, the proximal end of the elongated drying arms being pivotally mounted to the body within the elongated handle channel and the shaft being slidably engaged within the elongated handle channel, so that sliding of a proximal end of the shaft triggers pivoting of the elongated drying arms upon contact with the proximal end of each one of the elongated drying arms.

In some implementations, at least one drying arm of the plurality of elongated drying arms comprises a proximal section and a distal section translatable with respect to the proximal section thereof so as to change a length of the at least one drying arm.

In some implementations, at least one of the elongated drying arms comprises at least one abutment flange protruding laterally to offer an abutment surface abutting the main body when the drying rack is in the non-operative configuration.

In some implementations, the main body comprises a plurality of elongated cavities extending along sides of the main body, each one of the elongated cavities having an opening being shaped and configured to contain at least a portion of a respective one of the elongated drying arms when resting along the main body in the non-operative configuration of the drying rack. Optionally, the main body has a front face and two opposed lateral faces, each of the front and lateral faces including a pair of the elongated cavities to receive a pair of first and second drying arms, the first drying arm being located above and in substantial alignment with the second drying arm. Further optionally, the first and second drying arms are receivable within the elongated cavities of the front face are slightly staggered with respect to the first and second drying arms receivable in the elongated cavities of the lateral faces. Further optionally, an operative angle defined between each one of the elongated drying arms and a longitudinal axis of the main body of the drying rack in operative configuration is between 45° and 90°.

In some implementations, the drying rack further includes a drying rack retainer assembly for securing the drying rack to a support in the non-operative configuration and in the operative configuration. Optionally, the main body has a rear face and the retainer assembly comprises at least one of the following members:

a clipping retainer connected to the main body of the drying rack to anchor the drying rack to a vertical elongated support; and a hanging retainer connected to the handle of the drying rack to hang the drying rack to a door or a partition of a wall.

In some implementations, the retainer assembly includes two clipping retainers which are respectively a lower brace and an upper brace connected to the rear face of the main body, the upper brace being opened downwardly while the lower brace being opened rearwardly so as to engage a handle of a suitcase or a sport bag, thereby supporting the drying rack either in the operative configuration or in the non-operative configuration.

In some implementations, the hanging retainer comprises a slit hook removably engageable with the gripping member of the handle of the drying rack to suspend the drying rack either in the operative configuration or in the non-operative configuration. Optionally, the hanging retainer is removably configurable to rest on the handle and along the main body when the drying rack is in non-operative configuration. Optionally, the hanging retainer includes a pair of U-shaped slotted members and the main body includes a pair of anchor members protruding laterally from the rear face of the main body, the hanging retainer being further securable to the rear face of the main body via the pair of U-shaped slotted members when the latter is engaged with the corresponding pair of anchor members of the main body.

In another aspect, there is provided a drying rack adapted to be mounted to a drying rack support spaced-apart from a floor. The drying rack includes:

a main body;

a plurality of elongated drying arms pivotably mounted to the main body and configurable between an arm-compacted configuration, wherein the elongated drying arms are juxtaposed to the main body and an arm-operative configuration wherein the elongated drying arms branch outwardly from the main body; and a drying rack retainer assembly mounted to the main body and engageable with the drying-rack support to support in a stable configuration above the floor.

In some implementations, the frying rack further includes a triggering assembly cooperating with the main body and each one of the elongated drying arms to selectively pivot the elongated drying arms towards the main body until the elongated drying arms are configured in the arm-compacted configuration; and pivot the elongated drying arms away from the main body until the elongated drying arms are configured in the arm-operative configuration; and wherein the triggering assembly comprises a shaft translatable with respect to the main body between a handle-operative configuration wherein a major length of the shaft extends outwardly of the main body and a handle-storage configuration wherein the major length of the shaft is contained in the main body.

In some implementations, the elongated drying arms extend radially from the main body in the arm-operative configuration and are juxtaposed to the main body in the arm-compacted configuration.

In other implementations, at least one of the elongated drying arms is a telescopic arm.

In another aspect, there is provided a drying rack comprising:

a main body comprising a plurality of elongated cavities; and a plurality of elongated drying arms pivotably mounted to the main body and being configurable between an arm-compacted configuration, wherein the elongated drying arms are at least partially inserted in a respective one of the elongated cavities, and an arm-operative configuration wherein the elongated drying arms branch outwardly from the main body and the respective one of the elongated cavities; and a triggering assembly cooperating with the main body and each one of the elongated drying arms and configurable in a rack-compacted configuration to maintain the elongated drying arms at least partially inserted the respective one of the elongated cavities and a rack-operative configuration to release the elongated drying arms from the respective one of the elongated cavities to be configured into the arm-operative configuration.

In some implementations, the triggering assembly cooperates with the main body and each one of the elongated drying arms to selectively pivot the elongated drying arms towards the main body until the elongated drying arms are configured in the arm-compacted configuration; and pivot the elongated drying arms away from the main body until the elongated drying arms are configured in the arm-operative configuration; and wherein the triggering assembly comprises a shaft translatable with respect to the main body between a handle-operative configuration wherein a major length of the shaft extends outwardly of the main body and a handle-storage configuration wherein the major length of the shaft is contained in the main body.

In some implementations, the elongated drying arms extend radially from the main body in the arm-operative configuration and are juxtaposed to the main body in the arm-compacted configuration. Optionally, at least one of the elongated drying arms is a telescopic arm.

BRIEF DESCRIPTION OF THE DRAWINGS

Embodiments of the expandable drying rack and components thereof are represented in and will be further understood in connection with the following figures.

Figure 1:
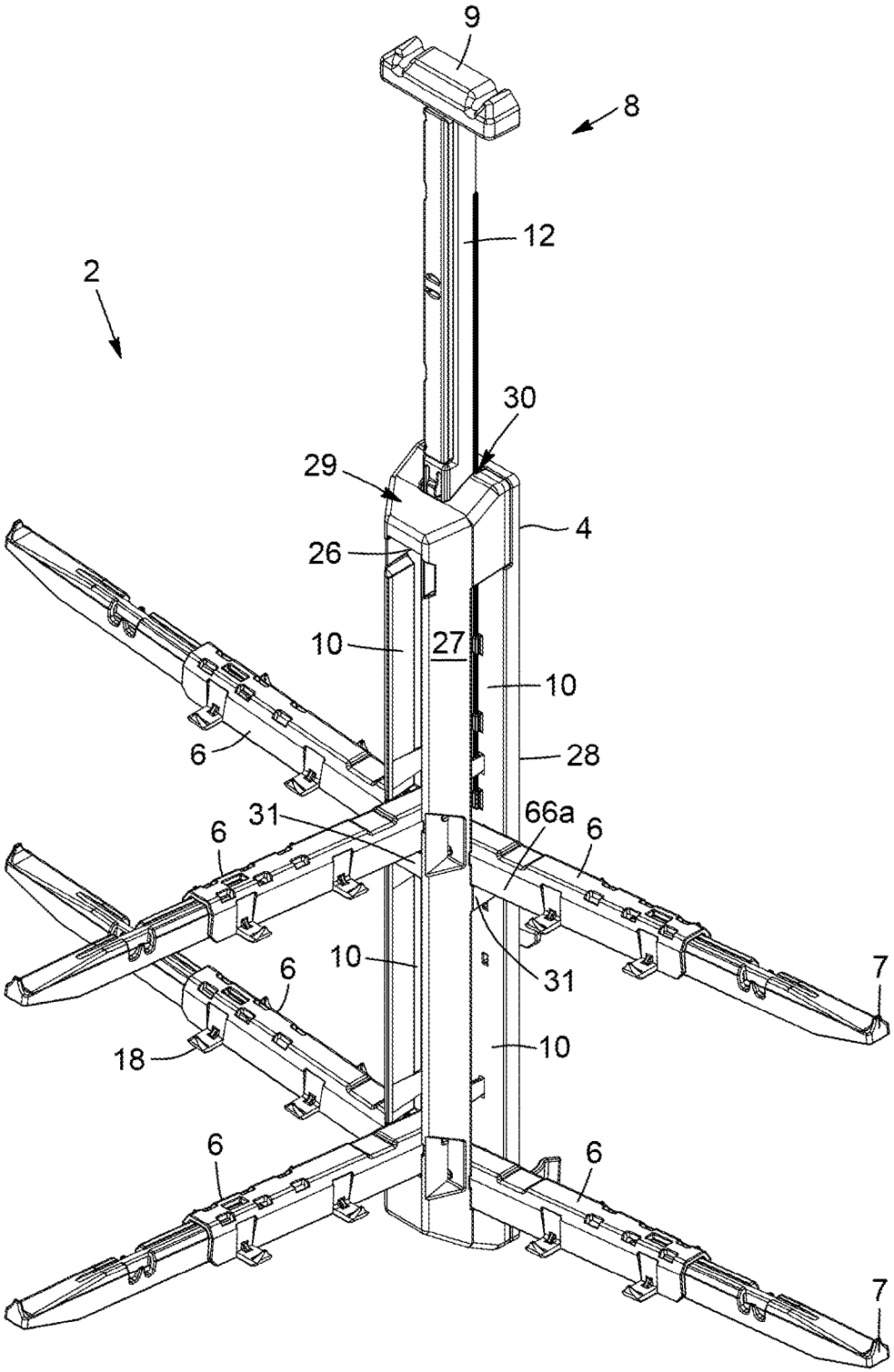
FIG. 1 is a perspective view of the drying rack in an operative configuration, in accordance with an embodiment.

While the drying rack will be described in conjunction with example embodiments, it will be understood that it is not intended to limit the scope of the drying rack to such embodiments. On the contrary, it is intended to cover all alternatives, modifications and equivalents as may be included as defined by the present description. The objects, advantages and other features of the present drying rack will become more apparent and be better understood upon reading of the following non-restrictive description, given with reference to the accompanying drawings.

DETAILED DESCRIPTION

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Although the embodiments of the drying rack and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the drying rack, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting. For example, FIGS. 1 and 10 include variations in the geometry of the specific parts of the drying rack without departing from the main function of these parts.

As used herein the singular forms "a", "an", and "the" include plural referents unless the context clearly dictates otherwise. Thus, for example, reference to "an arm" includes a plurality of such arms and reference to "the arm" includes reference to one or more arms and equivalents thereof known to those skilled in the art, and so forth. All technical and scientific terms used herein have the same meaning as commonly understood to one of ordinary skill in the art to which this invention belongs unless clearly indicated otherwise.

Drying Rack Configurations

Implementations of the drying rack (2) illustrated in FIGS. 1 to 3, 6, 8, 10 and 13 relate to an operative configuration wherein items (not illustrated in the Figures), such as wet cloths, can be hung to dry. The drying rack (2) includes a vertical main elongated body (4) from which horizontally extends a plurality of drying elongated arms (6). Each elongated arm (6) is configured and shaped to facilitate hanging of an item thereon.

It should be noted that the operative configuration may also be referred to as a deployed configuration, an open configuration, an extended configuration or a non-compacted configuration wherein one or more arms (6) extend from the main body. Optionally, at least one elongated arm (6) may be extendable to change a length thereof. Further optionally, the main body (4) can cooperate with a variety of retaining members ((14), (16) and (24) for example) to ensure fixation of the drying rack (2) onto a support (such as the luggage (20) illustrated in FIG. 6 for example). Therefore, the operative configuration may include multiple operative sub-configurations depending on the length of each drying arm (6) and depending on which type of retaining members is used for supporting the rack (2).

Implementations of the drying rack (2) illustrated in FIGS. 4, 5, 9, 11 and 14 relate to a non-operative configuration wherein the drying rack (2) has a reduced size to facilitate packing and transportation thereof. In the non-operative configuration, the drying elongated arms (6) are retracted and configured to rest along the main elongated body (4). Optionally and as illustrated on FIGS. 1 and 4, each arm (6) may be at least partially received into a respective elongated cavity (10) defined in the main body (4), such that at least a portion of each arm (6) is contained in each respective cavity (10) to further reduce the size of the drying rack when compacted.

It should be noted that the non-operative configuration may be referred to as a compacted configuration, a closed configuration, a retracted configuration, a contained configuration or a reduced-size configuration. Optionally, the retaining members ((14), (16) and (24)) may be coupled, combined or juxtaposed with the remaining element of the drying rack (2), such that multiple non-operative sub-configurations can be used.

The drying rack further includes a triggering assembly that is actionable to deploy the arms and transition from a non-operative configuration to an operative configuration. The triggering assembly may serve as an arm-retaining assembly which retains the arms of the rack along the main body during compaction, and which when actuated, releases the arms of the rack away from the main body for drying operation.

Figure 4:
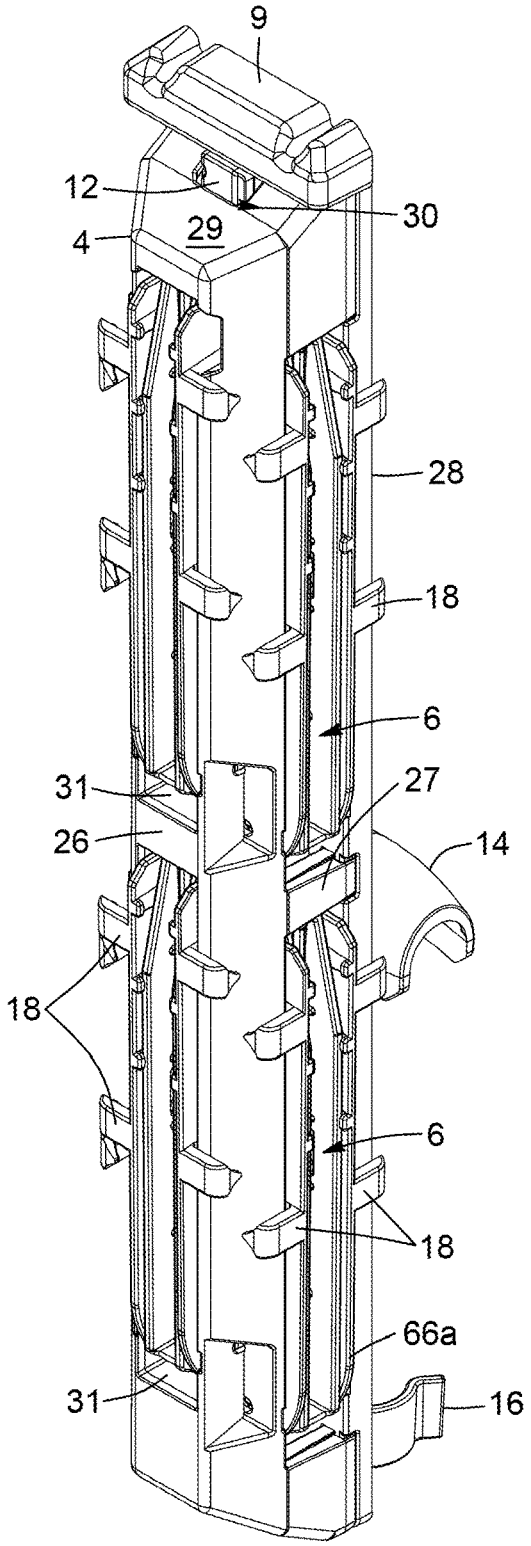
FIG. 4 is a perspective view of the drying rack of FIG. 1 in a non-operative compacted configuration.

Referring to FIGS. 1 and 4, reversible transition of the drying rack (2) from the non-operative configuration to the operative configuration is performed by pulling a handle (8) which is slidably engaged with the main body (4) through a handle shaft (12). In some implementations, this outward movement of the handle (8) simultaneously provokes branching of the arms (6) out of the main body (4). For switching back the drying rack (2) from the operative configuration to the non-operative configuration, the handle (8) is pushed toward the body (4) in such a manner that the shaft (12) is slidably inside the body (4), thereby provoking pivoting of the arms (6) towards the main body (4).

It should be understood that various terms may be used to qualify the configurations or positions in which parts of the drying rack are when the rack is in operative configuration or non-operative configuration.

More particularly, when the rack is in the non-operative configuration (also referred to as rack-compacted configuration), the elongated arms of the rack are in an arm-compacted configuration (also referred to as an arm-retained configuration) and the handle is in a handle-storage configuration. Alternatively, when the rack is the operative configuration (also referred to as a rack-operative configuration), the elongated arms of the rack are in an arm-operative configuration (also referred to as an arm-extended configuration) and the handle is in a handle-operative configuration (also referred to as a handle-extended configuration). It should further be noted that the triggering of a specific configuration for a part of the rack may simultaneously induce configuration of another part of the rack, depending on the way the parts are related. For example, triggering of the handle-operative configuration by pulling the handle may simultaneously induce deployment of the arms in the arm-operative configuration. The below table summarizes the configurations that may be referred to herein.

| CONFIGURATIONS | |
|---|---|
| NON-OPERATIVE | OPERATIVE |
| Rack-compacted | Rack-operative |
| Handle-storage | Handle-operative (handle-extended) |
| Arm-compacted (Arm-retained) | Arm-operative (Arm-extended) |

Drying Rack Implementations

In one aspect, there is provided a foldable drying rack, including a main body, a plurality of elongated arms connected to the main body and a triggering assembly inducing, upon actuation thereof, spreading of the arms away from the main body for drying operation. Number, size and position of the arm with respect to the main body may vary, thereby offering multiple-level hanging points for items to be dried. The foldable drying rack further includes a retainer assembly connectable to the main body of the rack for offering at least one anchoring point to various type of supports. The retainer assembly may include clipping elements to anchor the drying rack to a telescopic handle of a suitcase for example, and may also include hanging elements to anchor the drying rack to a door, shower curtain rod or closet rod for example. The retainer assembly may further include fastening means, such as screws, to further enhance anchoring of the rack onto the selected support.

Referring to FIG. 1, the elongated body (4) includes a front face (26), a rear face (28), opposed to the front face (26), and two lateral faces (27) extending between the front and rear faces (26, 28). The elongated body (4) also includes a top face (29), at a junction of the front, rear, and lateral faces (26, 28, 27). The drying rack (2) includes first and second arms (6) pivotably mounted on each of the front face and two lateral faces (26, 27, 28) of the main body, such that the first arm (6) can be deployed above the second arm (6) in a parallel relationship when the rack (2) is in operative configuration. For each pair of first and second arms (6), the arms (6) mounted to the front face (26) of the body (4) may be pivotally mounted slightly above the arms (6) mounted to the lateral faces (27) of the body (4) with the arms (6) pivotally mounted to the lateral faces (27) of the body (4) being substantially aligned with one another.

In alternative implementations not shown on the Figures, all pair of first and second arms can be substantially aligned. Optionally, the arms mounted to the front face of the body can be pivotally mounted below the arms mounted to the lateral faces of the body. Further optionally, the two pairs of arms mounted to the respective two lateral faces of the body can be vertically offset from one another.

In some implementations, an operative angle defined between the deployed arms and a longitudinal axis of the main body (4) is between 45 degrees and 90 degrees. Optionally and as seen on FIGS. 1 to 3, 6, 8, 10 and 13, the deployed arms (6) may protrude from the body (4) at about 90 degrees with respect to the longitudinal axis thereof. It should be noted that the angle may be selected to reduce or prevent sliding of the items towards the main body (4) of the rack (2).

It should be understood that the geometry and shape of the main body may vary to accommodate for the elongated arms. For example, the arms may be fully contained within the body when the rack is in a compacted configuration. Alternatively, the arms may simply be pivoted towards the main body to rest along and on an external surface of the body without departing from the scope of the present invention. In some implementations, the main body may be configured to receive at least partially each arm in a corresponding cavity when the rack is in the non-operative configuration. The cavity advantageously enable to promote compaction of the drying rack for packing when stored or transported.

Referring to FIG. 1, each one of the front and lateral faces (26, 27 and 28) of the body (4) has two elongated cavities (10) defined therein. The two elongated cavities (10) are defined consecutively in their respective faces (26, 27), extending downwardly from the top face (29). It is appreciated that the number, the shape, and the configuration of the elongated cavities (10) can vary from the implementations shown. One arm (6) is associated to each one of the elongated cavities (10). The proximal end of each arm (6) is pivotally mounted to the elongated body (4) about a lower end of the corresponding respective elongated cavity (10).

In an alternative embodiment (not shown on the Figures), the elongated body can be free of elongated cavities and the arms can be solely juxtaposed to the elongated body in the arm-compacted configuration.

It should be noted that each arm may be pivotally secured to the main body by any pivoting means available to one skilled in the art.

In implementations illustrated on FIGS. 1 and 4, the triggering assembly may include a handle (8) having a gripping member (9) and a shaft (12), the handle (8) being translatable with respect to the main body (4) by reversible extension of the shaft (12) upon pulling the gripping member (9) away from the body (4). The gripping member (9) extends substantially normal to the handle shaft (12) at a distal end thereof. The shaft (12) is at least partially received in an elongated handle channel (30) of the main body (4), which extends downwardly therein from the top face (29). The elongated handle channel (30) is sized and shaped to at least partially contain therein the shaft (12) of the handle (8)

in the compacted configuration. Optionally, the elongated handle channel (30) is at least partially open on the rear face (28) of the main body (4).

Figure 2:
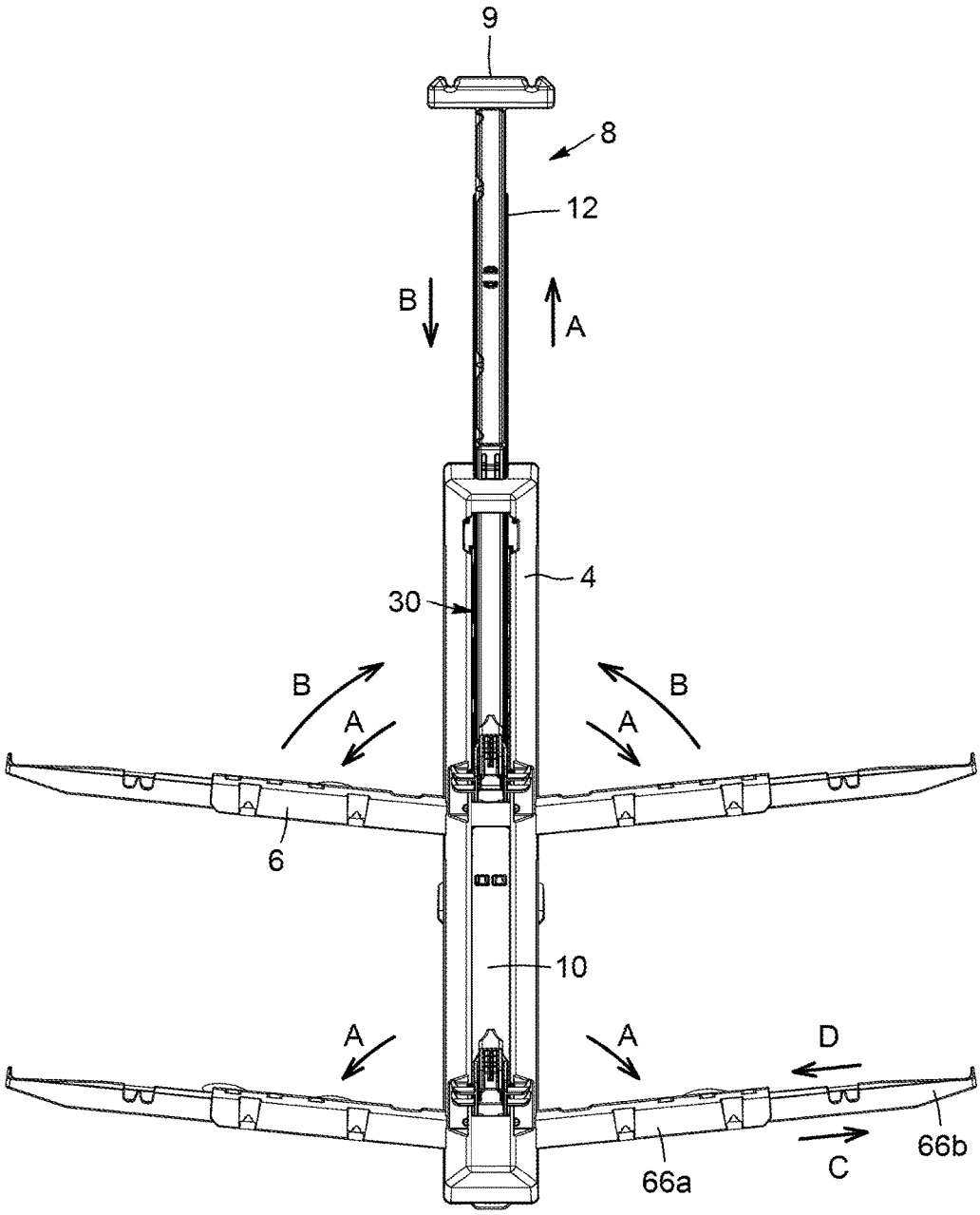
FIG. 2 is a front elevational view of the drying rack of FIG. 1 showing a plurality of arms and a handle in the operative configuration.
Figure 3:
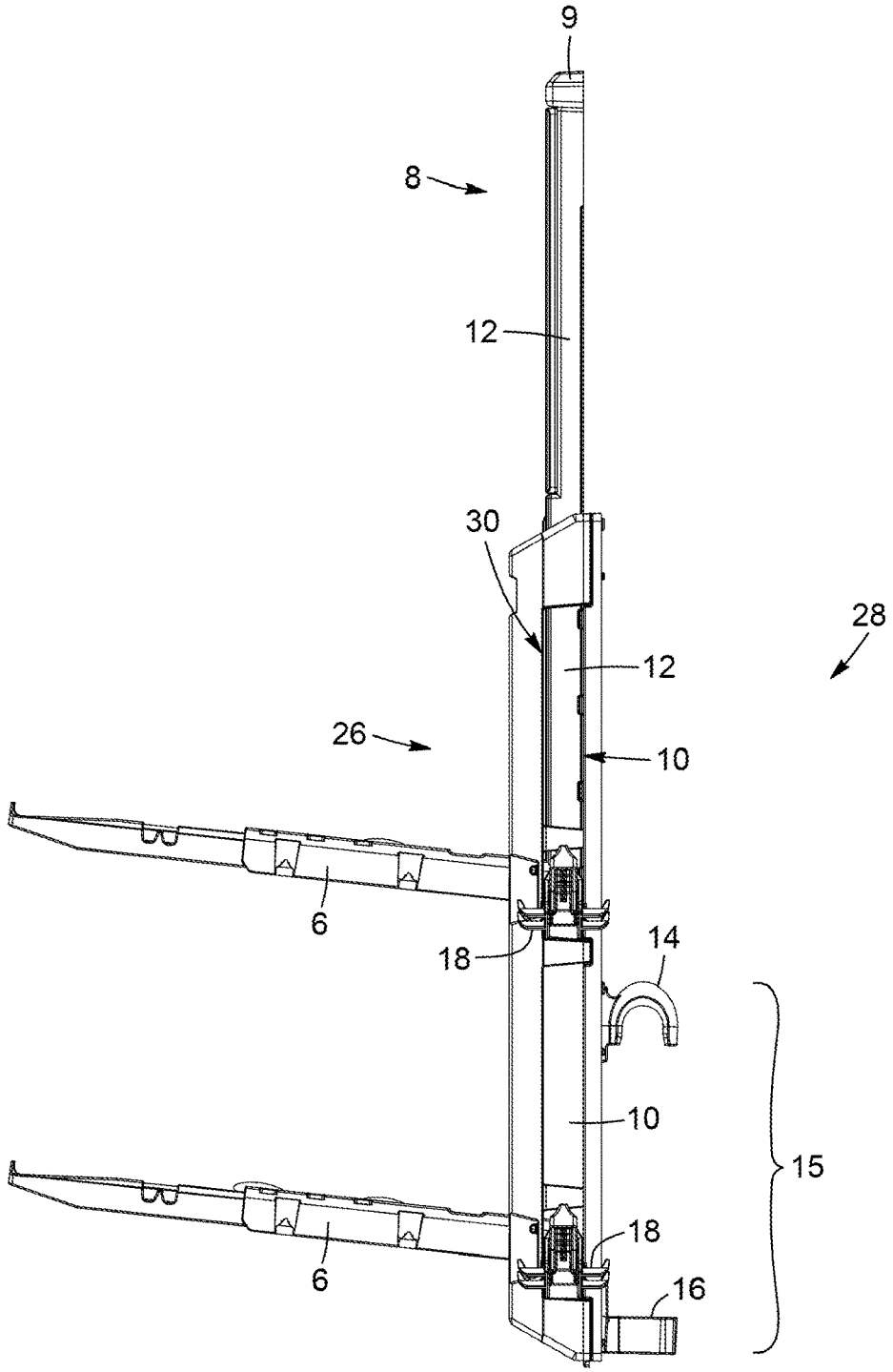
FIG. 3 is a side elevational view of the drying rack of FIG. 1 showing the arms and handle in the operative configuration.

Referring to FIGS. 1 to 4, the handle (8) is translatable with respect to the elongated body (4) and, more particularly, translatable inside the elongated handle channel (30). The handle (8) translates between the handle-storage configuration (FIG. 4) and the handle-operative configuration (FIGS. 1 to 3). In the handle-storage configuration, the handle (8) is at least partially contained inside the elongated body (4). In the handle-operative configuration, a major length of the shaft (12) of the handle (8) protrudes (extend) outwardly from the elongated body (4). In the embodiment shown, in the handle-operative configuration, the handle (8) protrudes outwardly from the top face (29) of the elongated body (4). The handle-operative configuration and the handle-storage configuration of the handle (8) respectively correspond to the operative configuration (FIGS. 1 to 3) and the compacted configuration (FIG. 4) of the drying rack (2). As mentioned above, in an embodiment, by configuring the handle (8) into a respective one of the handle-operative configuration and the handle-storage configuration, the arms (6) are simultaneously configured in the corresponding one of the arm-operative configuration and the arm-compacted configuration.

It should be understood that the configuration and cooperation of the handle with the main body may differ from the embodiment illustrated in the Figures. In other implementations, the handle be juxtaposed to the body such that the shaft slides along the body during transition between the rack-compacted configuration and the rack operative configuration.

Drying Rack Conversion Implementations

As mentioned-above, the triggering assembly of the drying rack is actionable to deploy the arms and transition from the non-operative configuration to the operative configuration wherein items can be hung on the deployed arms to dry. The triggering assembly therefore cooperate with the main body and arms to reversibly retain the arms along the body for compaction and spread the arms away from the body for drying operation.

FIG. 2 shows the different movements of the handle (8) and arms (6) to convert the drying rack from the operative configuration to the non-operative configuration ( and vice versa ). FIG. 2 shows an embodiment in operative configuration where arrows "A" and "B" represent directions of movements to switch between the operative configuration and the non-operative configuration. Arrows "A" shows the outward translation of the shaft (12) of the handle (8) inducing branching of the elongated arms (6) out of their respective cavity (10). Each proximal end of the arms (6) is pivotally engaged within the elongated handle channel (30) of the body (4). Arrows "B" show the direction of the shaft (12) translation when being slidably inserted in the elongated handle channel (30) of the body (4) inducing retraction of the arms (6) in juxtaposition to the body (4).

Referring to FIG. 1, the main body (4) includes a pair of abutment portions (31) disposed on each of the front face (26) and two lateral faces (28 and 29). Each abutment portion (31) is configured to offer an abutment surface to the proximal end of each arm when the arms are deployed for drying operation. Contact or engagement between the abutment portion (31) of the body (4) and the arms (6) limits the downwardly oriented pivoting movement of the arms (6). In the embodiment shown, the engagement between the abutment portion (31) of the body (4) and the arms (6) maintain the arms (6) at about 90 degrees with the longitudinal axis of the elongated body (4) in the operative configuration of the drying rack (2). The engagement between the abutment portion (31) of the body (4) and the arms (6) also prevents further downwardly oriented pivoting movement of the arms (6) when weight is applied on the arms (6), for instance when clothing or equipment is suspended on the arms (6) for drying purposes.

Referring to FIG. 2, when the handle (8) is translated outwardly of the body (4), the arms (6) are sequentially (from the lower ones to the upper ones) configured in the arm-operative configuration. The arms (6) are configured in the arm-operative configuration by gravity when their distal end moves downward thus leading down the proximal end that pivots into the elongated handle channel (30).

Referring to FIGS. 1 and 4, when configuring the drying rack (2) from the operative configuration to the non-operative configuration, as mentioned above, the handle (8) is translated downwardly into the elongated handle channel (30). The inside end of the shaft (12) of the handle (8) (not shown) sequentially abuts each one of the proximal ends of the elongated arms (6). When pressure is applied on their proximal ends, the arms (6) pivot upwardly until they abut the elongated body (4), i.e. they are juxtaposed to the body (4) and, in the illustrated embodiment, at least partially contained in the respective one of the elongated cavities (10).

Referring to FIG. 4, the proximal ends of the arms are connected to the main body within the elongated handle channel (30). Thus, when the shaft (12) of the handle (8) is contained inside the elongated handle channel (30), abutment of the proximal ends of the arms (6) with the shaft (12) of the handle (8) prevents the downwardly oriented pivoting movement of the arms (6) to be configured into the arm-operative configuration.

Arm Implementations

In some implementations, the arms of the drying rack may be designed and shaped to include protruding elements having several functions, including abutment function, hanging function, sliding function or a combination thereof.

According to a particular embodiment as shown in FIG. 2, each one of the arm (6) may be telescopic, such that when in operative configuration, the length of the arm can be extended along arrow "C". When telescopic, each one of the telescopic arm includes at least two sections, a proximal section (66*a*), proximal to the body (4), and a distal section (66*b*), distal to the body (4). The proximal section (66*a*) is pivotably mounted to the body (4) and the proximal section (66*b*) is slidably translatable along a longitudinal axis of the arm (6), to extend a length thereof. In the embodiment shown, the arms (6) are manually configured between an extended configuration and a retracted configuration. Variation of the length of each drying arm advantageously offer selection of a drying surface adapted to the item to be hung.

Still referring to FIG. 2, each arm is configured into the retracted configuration by applying pressure on the distal section (66*b*) thereof in a direction represented by arrow "D". In the retracted configuration, the arms (6), when telescopic, have a shortened length. In an embodiment, the arms (6) should be manually converted into the retracted configuration prior to being configured into the arm-compacted configuration wherein they are juxtaposed to the body (4) and optionally, at least partially inserted in a respective one of the elongated cavities (10). In an alternative embodiment, the arms (6) can be automatically converted into the retracted configuration when the arms (6) are configured into the arm-compacted configuration (by translating the handle (8) into the elongated handle channel (30)), for instance by gravity. Thus, upon converting the drying rack (2) from the operative configuration to the non-operative configuration, the proximal section of the arm (66*b*) slidably translates along arrow "D" to retract at least partially along or within the proximal section (66*a*) to shorten the length of the arms (6) to fit within a length of respective one of the elongated cavities (10). In an embodiment, the arms (6) are manually converted into the extended configuration, following configuration of the arms (6) into the arm-operative configuration, by pulling the distal section (66*b*) of the arms (6) in a direction represented by arrow "C".

It is appreciated that the number of sections of the telescopic arms can vary from the embodiment shown. It is also appreciated that only a few of the arms of the drying rack can be telescopic arms.

In the implementations illustrated in FIGS. 3 and 4, each one of the arms (6) can include one or more abutment flange (18) protruding laterally away from the arm. The abutment flanges (18) are configured to abut to the body (4) when the arm is configured in the arm-compacted configuration at least partially contained inside the respective one of the elongated cavities (10) (better seen on FIG. 4).

In some implementations, each arm may include at least one protruding hanging element that may serve as an additional hanging point for items to be hung. For example, as illustrated in FIG. 1, each arm (6) may include a protruding element (7) at the distal end thereof, providing a hanging point and ensuring that items spread along the arm do not slide away from the distal end of the arm (6). It should be noted that the abutment flanges (18) may also serve as additional hanging points.

Figure 10:
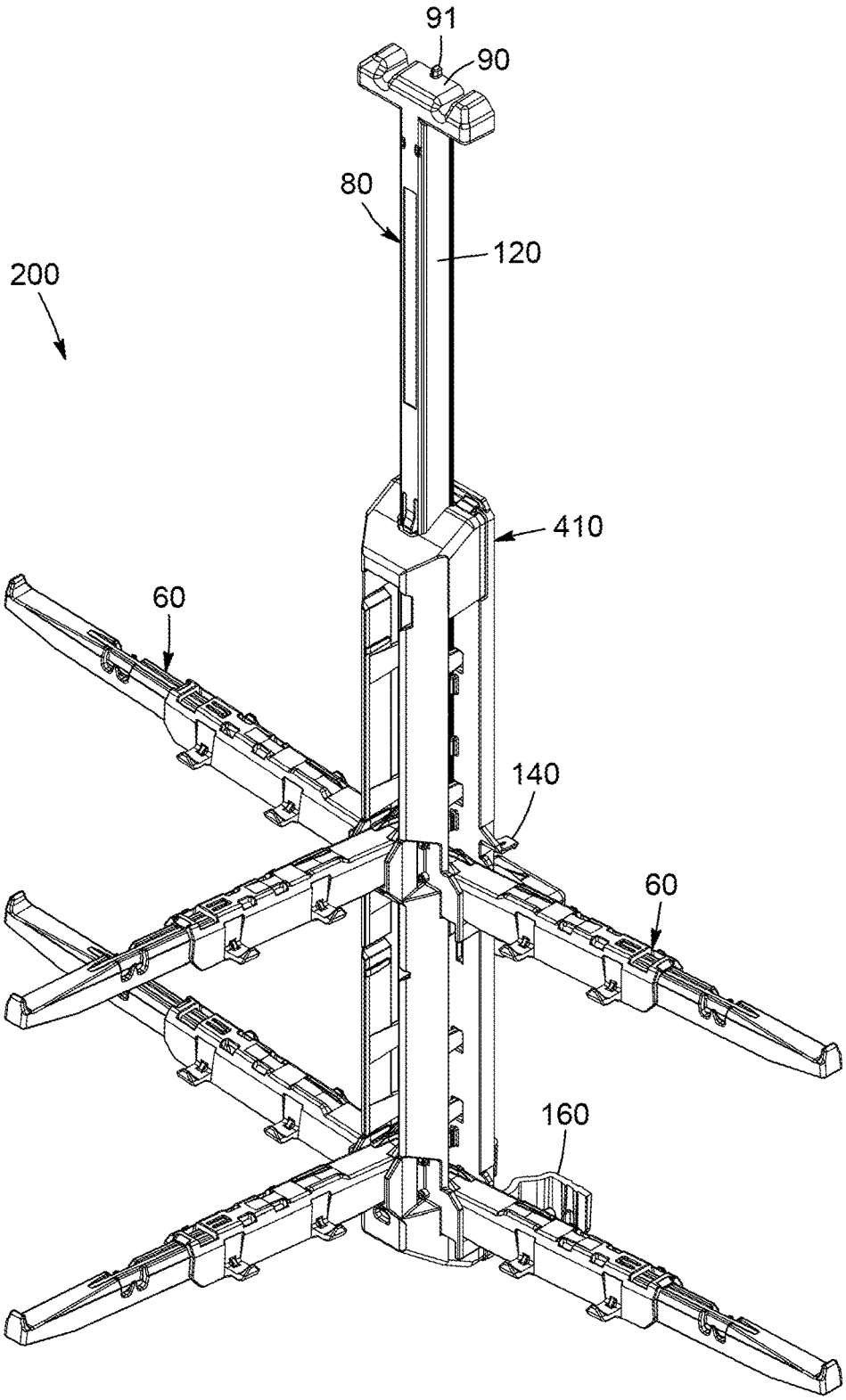
FIG. 10 is a perspective view of the drying rack in an operative configuration, in accordance with another embodiment.
Figure 11:
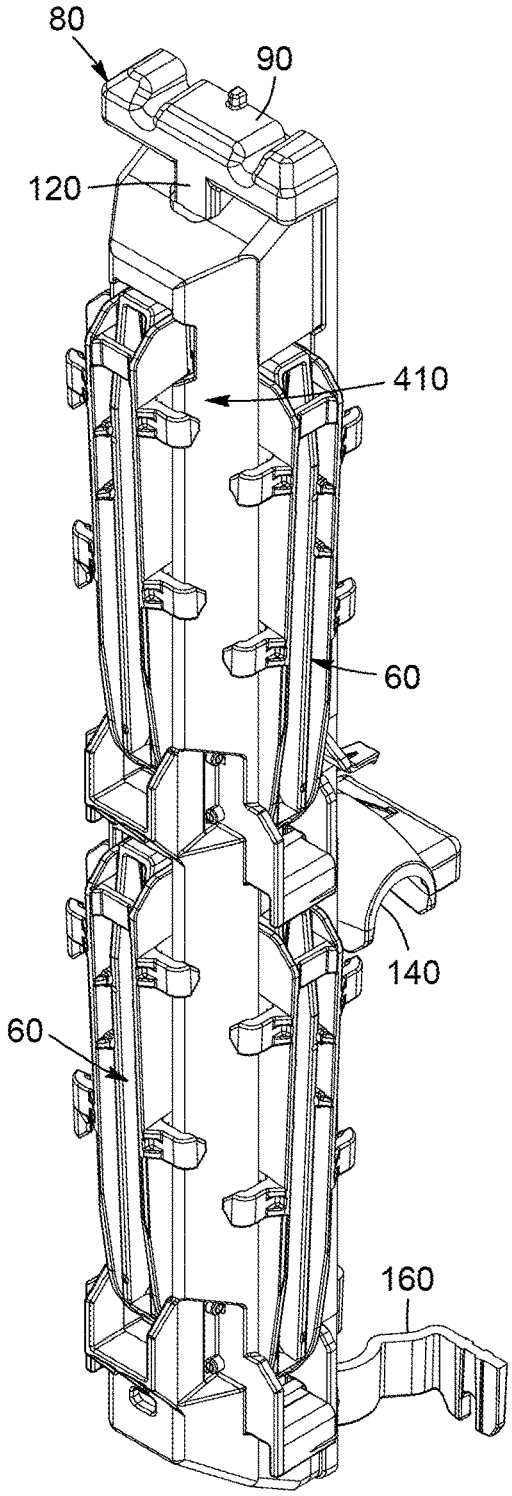
FIG. 11 is a perspective view of the drying rack of FIG. 10 in a non-operative compacted configuration.

It should be noted that FIGS. 10 and 11 show variations in the design of the main body (40), arms (60) and handle (80). For example, the gripping member (90) may include a trigger (91) for actuating retraction of the shaft (120). In addition, parts of the body (40) and arms (60) may be molded differently from the ones shown on FIGS. 1 to 6, such that differences in shapes and geometry may occur without departing from the function of each part as defined herein.

Retainer Assembly Implementations

The foldable drying rack further includes a retainer assembly connectable to the main body of the rack for offering at least one anchoring point to various type of supports, such as a door, a wall or a suitcase which are easily available when travelling.

Figure 12A:
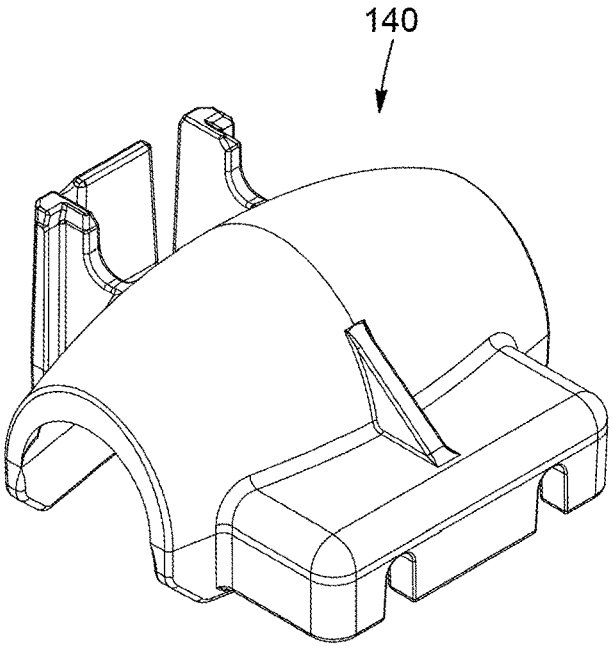
FIG. 12 includes perspective views of (A) another upper brace; and (B) another lower brace for supporting the drying rack, which are alternative braces to the ones illustrated in FIG. 7.
Figure 12B:
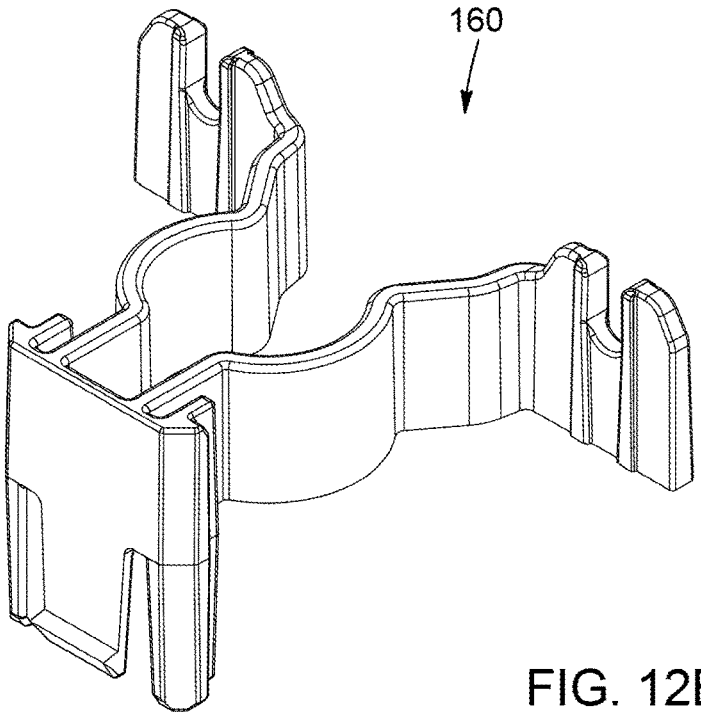

FIGS. 7 and 12 show upper and lower braces (14, 16, 140 and 160) of the retainer assembly that may be coupled to the rear face of the body; FIGS. 8, 9, 13 and 14 show a hanging retainer (24, 240) that may be coupled to the handle (8, 80) of the rack.

Particularly shown on FIG. 3, the rear face (28) of the body (4) is free of arm pivotally mounted thereto, so as to be easily juxtaposed against a surface or door, a wall or any other type of support. The drying rack retainer assembly (15) can include an upper brace (14) and a lower brace (16) which allow mounting or supporting the drying rack (2) on a drying rack support, either in the operative or the non-operative configuration (as seen on FIGS. 5 and 6).

In the embodiment shown in FIGS. 1 to 4, better shown in FIG. 3, the drying rack retainer assembly (15) is configured to engage a handle of a suitcase or a sport bag as drying rack support, as will be described in further details below, and includes the upper brace (or U-shaped clip)(14) and the lower brace (or U-shaped clip) (16), mounted to the rear face (28) of the body (4). The upper brace (14) is opened downwardly while the lower brace (16) is opened rearwardly. In an embodiment, the drying rack retainer assembly (15) is made of a rigid, relatively flexible and resilient material to allow engagement between the braces (14, 16) and a drying rack support, i.e. insertion of the drying rack support into the braces (14, 16). Referring to FIG. 12, alternative embodiments of an upper brace (140) and a lower brace (160) may be coupled to the rear face of the body of the rack for clipping to the handle of a suitcase or sport bag (not illustrated in FIG. 12).

Figure 5:
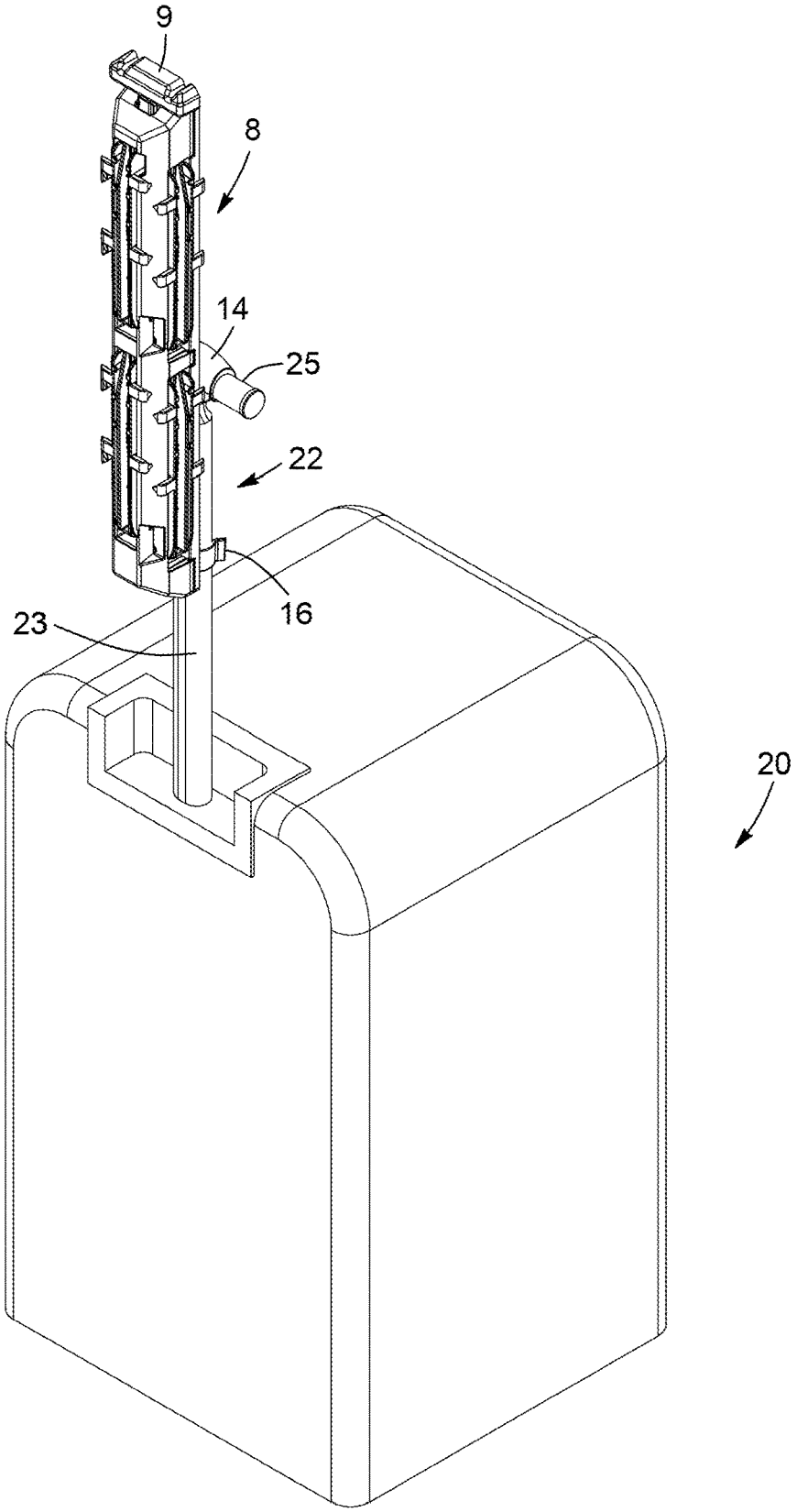
FIG. 5 is a perspective view of the drying rack of FIG. 1 in the non-operative configuration and mounted to a suitcase handle with a rack retainer assembly.
Figure 6:
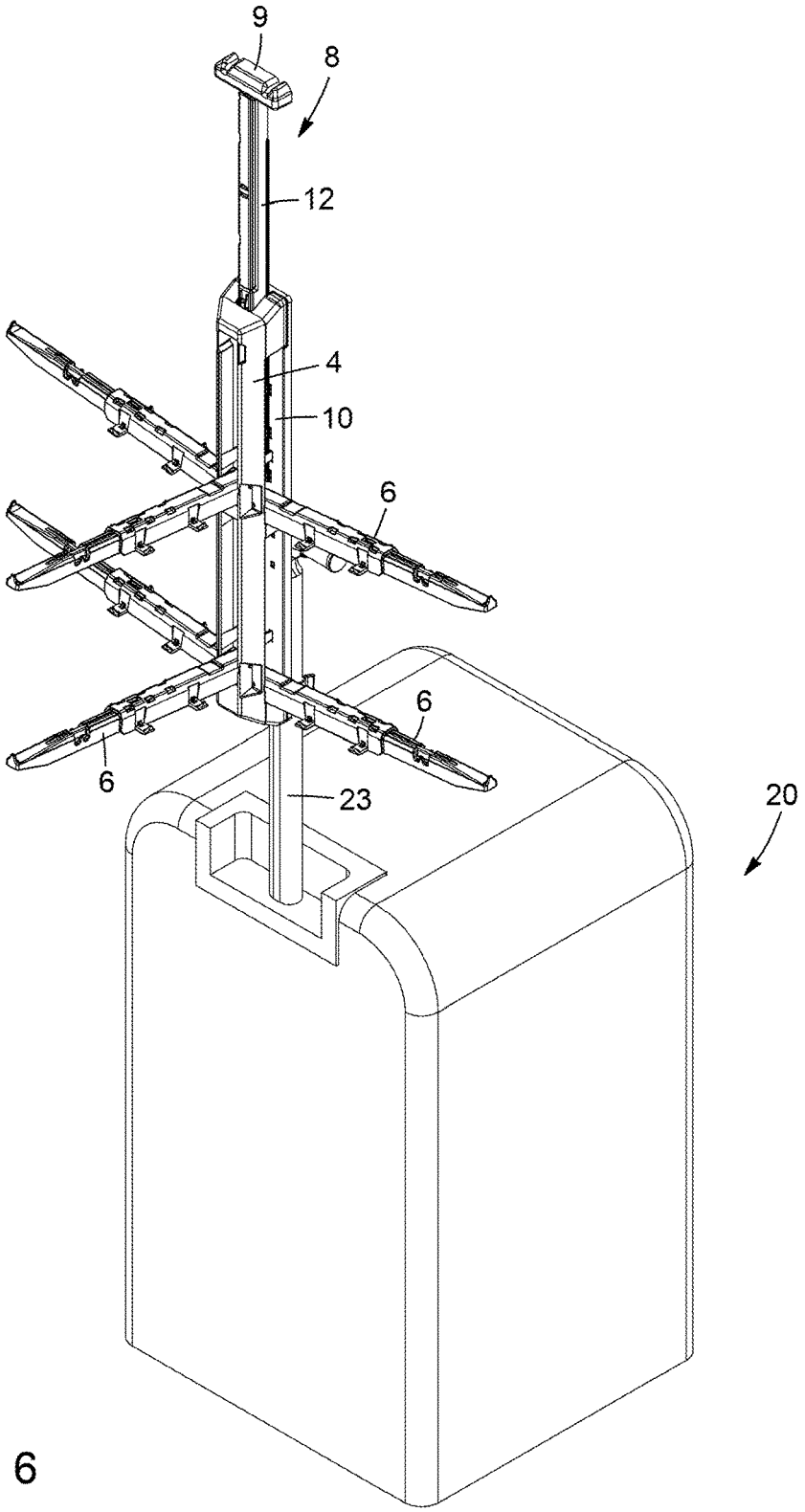
FIG. 6 is a perspective view of the drying rack mounted to the suitcase handle, as shown in FIG. 5, wherein the drying rack is configured in operative configuration.

Turning now to FIGS. 5 and 6, engagement of the drying rack (2) (shown in FIGS. 1 to 4) with a suitcase (20) will be described. In the embodiment shown and as mentioned above, the drying rack retainer assembly (15) is configured to engage a handle (22) of the suitcase (20). The handle (22) of the suitcase (20) includes a handle shaft (23) and a gripping part (25), extending substantially normal to the handle shaft (23) at a distal end thereof. The upper and lower braces (14, 16) of the drying rack retainer assembly (15) are configured to respectively engage the gripping part (25) and the handle shaft (23) of the suitcase handle (22). When engaged together, the upper and lower braces (14, 16) of the drying rack retainer assembly (15) partially surrounds the respective one of the gripping part and handle shaft (25, 23) of the drying rack support. When engaged to the suitcase handle (22), the drying rack retainer assembly (15) prevents the drying rack (2) from pivoting around, or sliding from, the suitcase handle (22). When engaged together, the drying rack (2) is stably supported by the suitcase handle (22), above the floor, and can be configured in the operative configuration (FIG. 6) and the compacted configuration (FIG. 5).

Figure 7A:
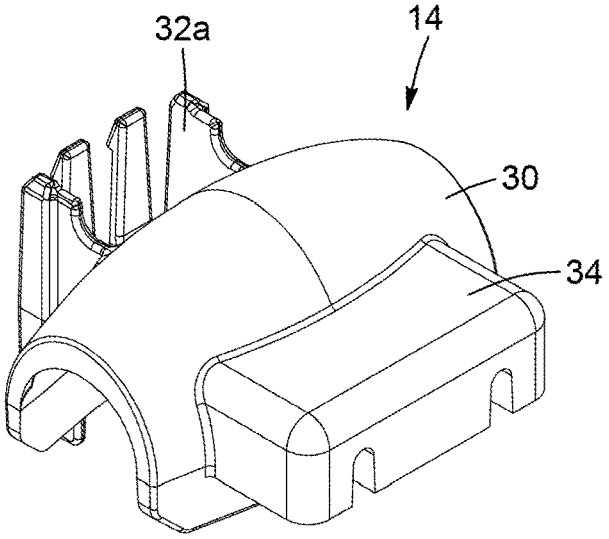
FIG. 7 includes perspective views of (A) an upper brace; and (B) an lower brace for supporting the drying rack.
Figure 7B:
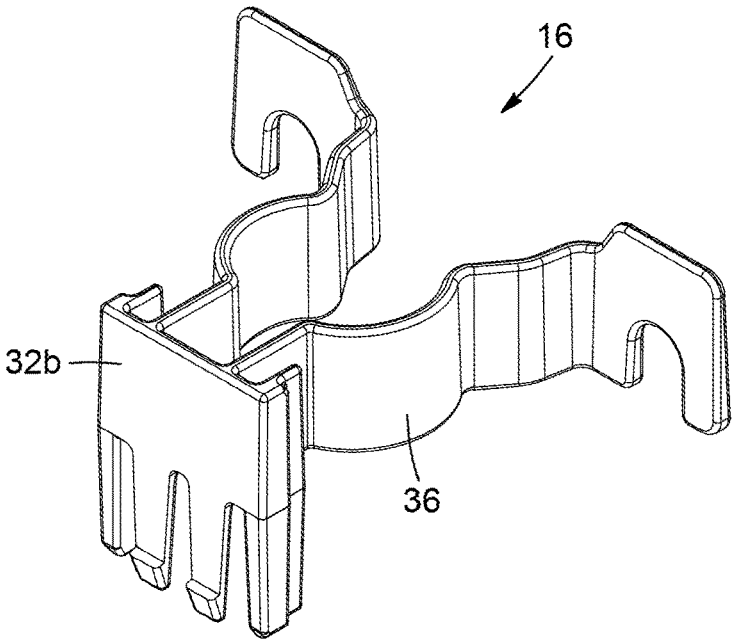

FIGS. 7A and 7B show the upper and lower braces (14, 16) in further details. The upper brace (14), shown in FIG. 7A, has a shape of a half-sleeve (30) adapted to be substantially nestingly engaged with the gripping part (25) of the suitcase handle (22). The upper brace (14) is detachably securable to the rack body (4) by way of a rack clip (32*a*). According to a particular embodiment, the upper brace (14) may also include a flange (34) defining a grab space for fingers to hold onto (for example, for removing the rack from the suitcase handle (22)). According to a particular embodiment, the lower brace (16), shown in FIG. 7B, includes a clamp bracket (36) shaped in such a manner as to engage by at least partially surrounding the handle shaft (23) of the suitcase (20). The clamp bracket (36) is detachably securable to rear face (28) of the body (4) through a rack clip (32*b*).

Figure 8:
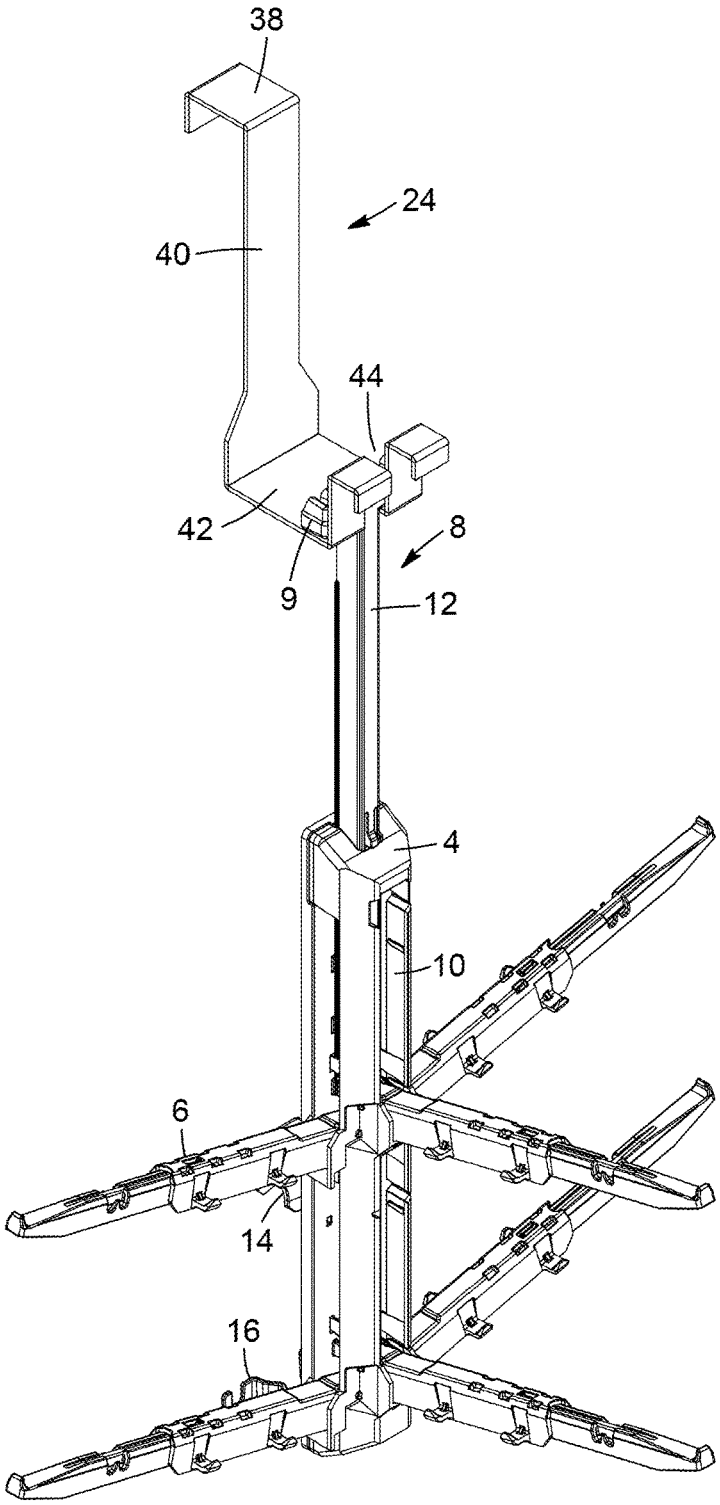
FIG. 8 is a perspective view of the drying rack of FIG. 1 in the operative configuration and supported by a hanging retainer.

FIG. 8 illustrates an embodiment of the drying rack (2) in operative configuration, with the arms (6) in the arm-operative configuration and the handle (8) pulled away from the main body (4) in the handle-operative configuration. In addition to the upper and lower braces (14 and 16), the retainer assembly of the rack (2) may include a hanging retainer (24) removably engaged with the gripping member (9) of the handle (8). The hanging retainer (24) may be suspendable over the top of a door, wall or partition for hanging the drying rack (2).

In the embodiment shown on FIG. 8, the hanging retainer (24) comprises a door abutment flange (38) connected to a slit hook (42) through a connecting member (40). The slit hook (42) allows easy engagement with the gripping part (9) of the handle (8) such that the shaft (12) extends through the slit (44) and the drying rack (2) hangs in a position that may be abutted against the door or other support (not illustrated in FIG. 8).

Figure 9A:
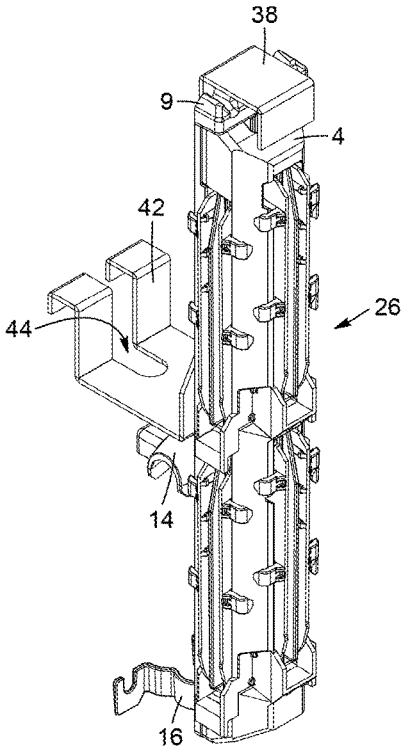
FIG. 9 includes perspective views of (A) the front face of the drying rack of FIG. 1 in the non-operative configuration when compacted and juxtaposed with different types of retainers, and (B) the rear face of the drying rack of FIG. 1 in the non-operative configuration when compacted and juxtaposed with different types of retainers.
Figure 9B:
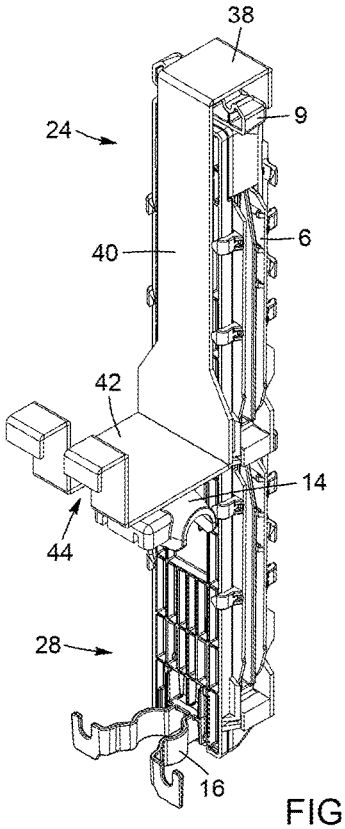

As shown in FIG. 9A, when the drying rack (2) is configured in the non-operative (i.e. compacted) configuration, the hanging retainer (24) may be juxtaposed thereto, such that the door abutment flange (38) rests on top of the handle (8) and the connecting member (40) is juxtaposed alongside the main body (4) of the drying rack (2). As seen in FIG. 9B, the hanging retainer (24) is sized so as to fit in a section of the rear face (28) of the elongated body (4), extending above the upper brace (14) to provide a compact system easily packed for storage, transporting and/or traveling purposes.

Figure 13:
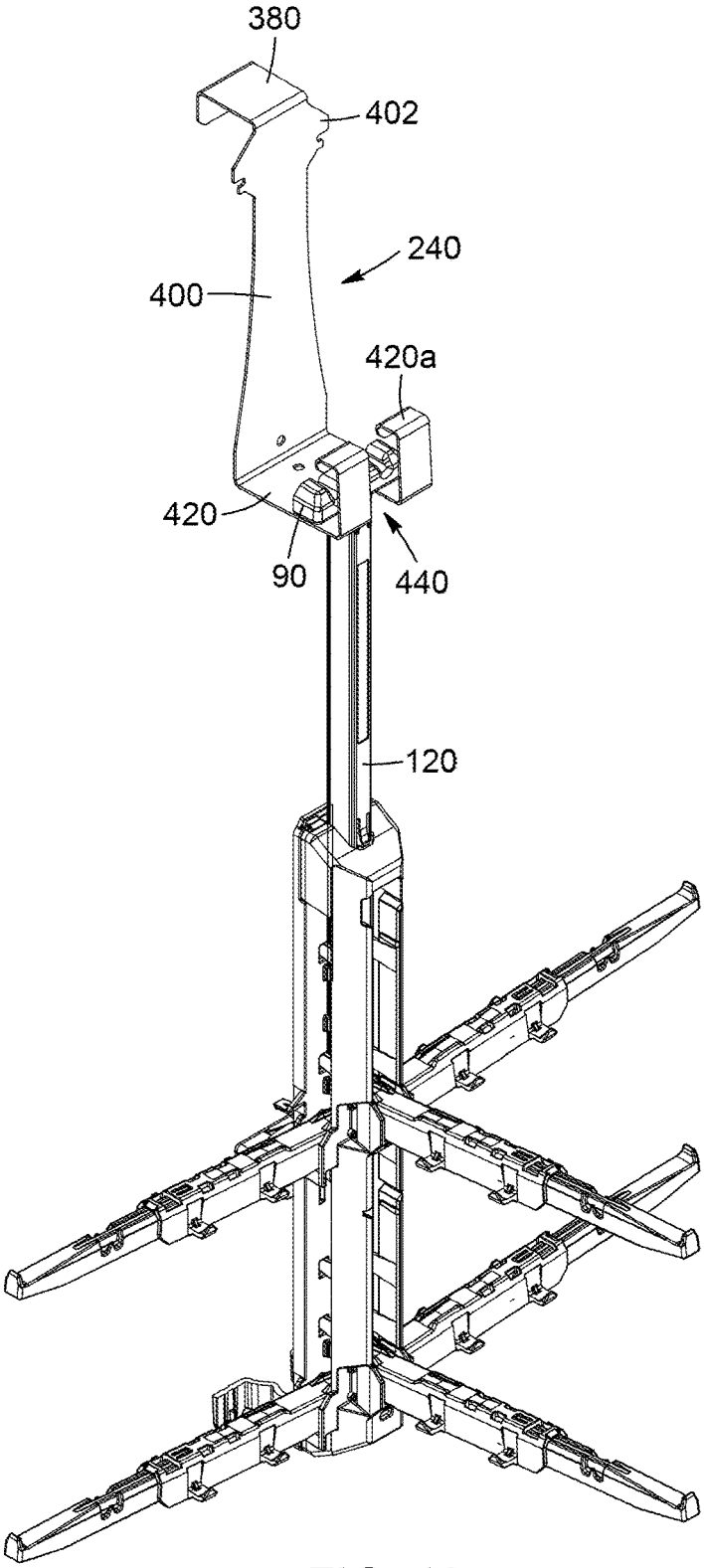
FIG. 13 is a perspective view of the drying rack of FIG. 10 in the operative configuration and supported by another hanging retainer, which an alternative retainer to the one illustrated in FIG. 8.
Figure 14:
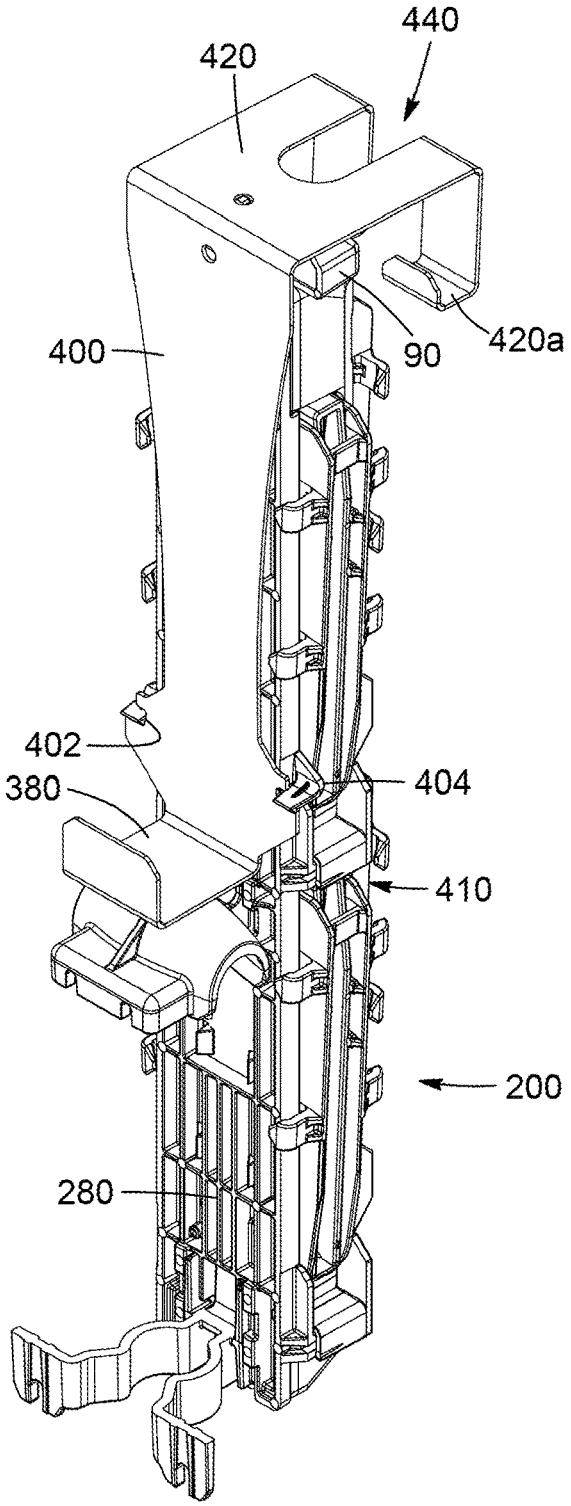
FIG. 14 is a perspective view of the rear face of the drying rack of FIG. 10 in the non-operative compacted configuration when combined with the hanging retainer illustrated in FIG. 13.

As shown on FIGS. 13 and 14, variations in the design of the hanging retainer (240) may exist. The distal end (420*a*) of the slit hook (420) may be bended towards the connecting member (400) to offer different complementary with the compacted rack when juxtaposed together as seen on FIG. 14 (in comparison to FIGS. 8 and 9). In this embodiment, the slit hook (420) rests on top of the handle (8) by abutting the gripping member (90) and the connecting member (400) is juxtaposed alongside of the rear face (280) of the main body (410) of the drying rack (200). The connecting member (400) is further secured to the rear face (280) via a pair of U-shaped slotted members (402) engageable with a corresponding pair of anchor members (404) protruding from the main body (410). This fastening mechanism enhances combination of the hanging retainer (240) with the main body (410) of the rack (200) in the non-operative configuration.

It is appreciated that, in an alternative embodiment, the drying rack can be free of drying rack retainer assembly. It can also include only one or more of the above-described embodiments of drying rack retainer assembly or any combination thereof. Furthermore, the drying rack retainer assembly can vary from the embodiments described above.

Drying Rack Use Implementations

The present drying rack is used, when in a non-operating configuration, for easy packing and transporting in a suitcase, sports bag or any other type of luggage. When the user is in need of drying wet items, be it clothes or sports equipment, the rack is pulled out of the luggage, installed on a support such as a suitcase handle or a door by way of the upper brace (14, 140), optionally with lower brace (16, 160) or the hanging retainer (24, 240) as seen on FIGS. 5, 8 and 13. Referring to FIG. 6, the rack (2) can then be configured in its operative configuration by pulling the handle (8) thus extending the shaft (12) and provoking (inducing) branching out (deployment) of the arms (6) in operating configuration. As will be easily understood by a person skilled in the art, each arm may be used to suspend a wet cloth, clothing item, or sport's equipment such as shoulder pads, knee pads, gloves, etc. for easy drying, even when the person/athlete is in a hotel room or locker room.

In addition, and according to a particular embodiment, when the drying rack (2) is supported by way of the upper brace (14) and lower brace (16) to a suitcase handle (22) as may be seen in FIG. 6, the drying rack handle (8) may also serve the purpose of a drying arm such that other clothes or even a helmet may be placed thereon for drying.

After the clothes or sport's equipment is dry, the items are removed from each arm (6) and/or the handle (8), configured into its non-operative (compacted) configuration for storage until further use.

The present product has been described in terms of particular embodiments found or proposed by the present inventor to comprise optional modes for the practice of the invention. It will be appreciated by those of skill in the art that, in light of the present disclosure, numerous modifications and changes can be made in the particular embodiments exemplified without departing from the intended scope of the invention. All such modifications are intended to be included within the scope of the appended claims.

All publications and patent applications cited in this specification are herein incorporated by reference as if each individual publication or patent application were specifically and individually indicated to be incorporated by reference.

The invention claimed is:

1. A drying rack reversibly configurable between a non-operative configuration and an operative configuration for drying operation, the drying rack comprising:

a main elongated body;

a plurality of elongated drying arms configured to receive items to be hung, each one of the elongated drying arms having a proximal end pivotably mounted to the main body; and a triggering assembly cooperating with the main body and each one of the elongated drying arms to selectively pivot the elongated drying arms towards the main body until the elongated drying arms rest along the main body in the non-operative configuration of the drying rack for storage or transportation, or pivot the elongated drying arms away from the main body until the elongated drying arms extends laterally away from the main body in the operative configuration of the drying rack to allow hanging of the items to dry;

the triggering assembly comprising a handle manually translatable along the main body to trigger the pivoting of the elongated drying arms, the handle comprising a shaft slidably engaged with the main body and a gripping member connected at a distal end of the shaft, wherein pulling of the gripping member away from the main body allowing expansion of a portion of the shaft out of the main body to pivot the elongated drying arms in the operative configuration.

2. The drying rack of claim 1, wherein the main body includes an elongated handle channel, the proximal end of the elongated drying arms being pivotally mounted to the body within the elongated handle channel and the shaft being slidably engaged within the elongated handle channel, so that sliding of a proximal end of the shaft triggers pivoting of the elongated drying arms upon contact with the proximal end of each one of the elongated drying arms.

3. The drying rack of claim 1, wherein at least one drying arm of the plurality of elongated drying arms comprises a proximal section and a distal section translatable with respect to the proximal section thereof so as to change a length of the at least one drying arm.

4. The drying rack of claim 1, wherein at least one of the elongated drying arms comprises at least one abutment flange protruding laterally to offer an abutment surface abutting the main body when the drying rack is in the non-operative configuration.

5. The drying rack of claim 1, wherein the main body comprises a plurality of elongated cavities extending along sides of the main body, each one of the elongated cavities having an opening being shaped and configured to contain at least a portion of a respective one of the elongated drying arms when resting along the main body in the non-operative configuration of the drying rack.

6. The drying rack of claim 5, wherein the main body has a front face and two opposed lateral faces, each of the front and lateral faces including a pair of the elongated cavities to receive a first and a second of the elongated drying arms respectively, the first elongated drying arm being located above and in substantial alignment with the second elongated drying arm.

7. The drying rack of claim 6, wherein the first and second elongated drying arms receivable within the respective elongated cavities of the front face are slightly staggered with respect to the first and second elongated drying arms receivable in the respective elongated cavities of the lateral faces.

8. The drying rack of claim 1, wherein an operative angle defined between each one of the elongated drying arms and a longitudinal axis of the main body of the drying rack in operative configuration is between 45° and 90°.

9. The drying rack of claim 1, further comprising a drying rack retainer assembly for securing the drying rack to a support in the non-operative configuration and in the operative configuration.

10. The drying rack of claim 9, wherein the main body has a rear face and the retainer assembly comprises at least one of the following members:

a clipping retainer connected to the main body of the drying rack to anchor the drying rack to a vertical elongated support; and a hanging retainer connected to the handle of the drying rack to hang the drying rack to a door or a partition of a wall.

11. The drying rack of claim 10, wherein the retainer assembly includes the clipping retainer as a first clipping retainer and further includes a second clipping retainer and wherein the vertical elongated support is a handle of a suitcase or a sport bag, the first and second clipping retainers being respectively a lower brace and an upper brace connected to the rear face of the main body, the upper brace being opened downwardly while the lower brace being opened rearwardly so as to engage the handle of a suitcase or a sport bag, thereby supporting the drying rack either in the operative configuration or in the non-operative configuration.

12. The drying rack of claim 10, wherein the hanging retainer comprises a slit hook removably engageable with the gripping member of the handle of the drying rack to suspend the drying rack either in the operative configuration or in the non-operative configuration.

13. The drying rack of claim 10, wherein the hanging retainer is removably configurable to rest on the handle and along the main body when the drying rack is in non-operative configuration.

14. The drying rack of claim 13, wherein the hanging retainer includes a pair of U-shaped slotted members and the main body includes a pair of anchor members protruding laterally from the rear face of the main body, the hanging retainer being further securable to the rear face of the main body via the pair of U-shaped slotted members when the latter is engaged with the corresponding pair of anchor members of the main body.

15. A drying rack adapted to be mounted to a drying rack support spaced-apart from a floor, the drying rack comprising:

a main body;

a plurality of elongated drying arms pivotably mounted to the main body and configurable between an arm-compacted configuration, wherein the elongated drying arms rest along the main body and an arm-operative configuration wherein the elongated drying arms extend radially and outwardly from the main body;

a triggering assembly cooperating with the main body and each one of the elongated drying arms to selectively pivot the elongated drying arms towards the main body until the elongated drying arms are configured in the arm-compacted configuration, and pivot the elongated drying arms away from the main body until the elongated drying arms are configured in the arm-operative configuration; and a drying rack retainer assembly mounted to the main body and engageable with the drying-rack support to support the drying rack in the arm-operative configuration above the floor.

16. The drying rack of claim 15, wherein the triggering assembly comprises a shaft translatable with respect to the main body between a handle-operative configuration wherein a major length of the shaft extends outwardly of the main body and a handle-storage configuration wherein the major length of the shaft is contained in the main body.

17. The drying rack of claim 15, wherein at least one of the elongated drying arms is a telescopic arm.

18. A drying rack comprising:

a main body comprising a plurality of elongated cavities; and a plurality of elongated drying arms pivotably mounted to the main body and being configurable between an arm-compacted configuration, wherein the elongated drying arms are at least partially inserted in a respective one of the elongated cavities and rest along the main body, and an arm-operative configuration wherein the elongated drying arms branch outwardly from the main body and the respective one of the elongated cavities; and a manually actuated triggering assembly translatable with respect to the main body and cooperating with each one of the elongated drying arms, the triggering assembly being selectively configurable:

in a rack-compacted configuration to maintain the elongated drying arms in the arm-compacted configuration, and in a rack-operative configuration to release the elongated drying arms into the arm-operative configuration upon translating a main portion of the triggering assembly away from the main body.

19. The drying rack of claim 18, wherein the triggering assembly cooperating with the main body and each one of the elongated drying arms to selectively pivot the elongated drying arms towards the main body until the elongated drying arms are configured in the arm-compacted configuration; and pivot the elongated drying arms away from the main body until the elongated drying arms are configured in the arm-operative configuration; and wherein the triggering assembly comprises a shaft translatable with respect to the main body between a handle-operative configuration wherein a major length of the shaft extends outwardly of the main body and a handle-storage configuration wherein the major length of the shaft is contained in the main body.

20. The drying rack of claim 18, wherein at least one of the elongated drying arms is a telescopic arm.

* * * * *